US011273419B2

(12) United States Patent
Dünger et al.

(10) Patent No.: US 11,273,419 B2
(45) Date of Patent: Mar. 15, 2022

(54) MIXING ELEMENTS WITH A REDUCED STRUCTURAL DEPTH FOR STATIC MIXERS

(71) Applicant: COVESTRO DEUTSCHLAND AG, Leverkusen (DE)

(72) Inventors: Udo Dünger, Leverkusen (DE); Thomas König, Leverkusen (DE)

(73) Assignee: COVESTRO DEUTSCHLAND AG, Leverkusen (DE)

( * ) Notice: Subject to any disclaimer, the term of this patent is extended or adjusted under 35 U.S.C. 154(b) by 390 days.

(21) Appl. No.: 16/339,015

(22) PCT Filed: Oct. 4, 2017

(86) PCT No.: PCT/EP2017/075244
§ 371 (c)(1),
(2) Date: Apr. 3, 2019

(87) PCT Pub. No.: WO2018/065480
PCT Pub. Date: Apr. 12, 2018

(65) Prior Publication Data

US 2019/0232239 A1 Aug. 1, 2019

(30) Foreign Application Priority Data

Oct. 5, 2016 (EP) ..... 16192324

(51) Int. Cl.
*B22C 5/00* (2006.01)
*B01F 5/06* (2006.01)

(52) U.S. Cl.
CPC ..... *B01F 5/0619* (2013.01); *B01F 5/0618* (2013.01); *B01F 2005/0626* (2013.01);
(Continued)

(58) Field of Classification Search
CPC ..... B01F 2005/0638; B01F 2005/0639
(Continued)

(56) References Cited

U.S. PATENT DOCUMENTS

2015/0087733 A1* 3/2015 Heusser ..... B29C 44/3415 521/79

FOREIGN PATENT DOCUMENTS

DE 2522106 A1 11/1976
DE 19501241 A1 * 8/1995 ..... B01F 5/0617
(Continued)

OTHER PUBLICATIONS

Machine translation for DE19501241 A1 (Year: 1995).*
(Continued)

*Primary Examiner* — Tony G Soohoo
*Assistant Examiner* — Gregory Y Huan
(74) *Attorney, Agent, or Firm* — K&L Gates LLP

(57) ABSTRACT

The invention relates to mixing elements with a reduced structural depth for static mixers, to static mixers comprising at least two mixing elements with a reduced structural depth, and to a method for mixing fluids using a mixing element with a reduced structural depth or a static mixer comprising at least two mixing elements with a reduced structural depth. In the mixing elements, the thickness of the transverse strut at its thickest point is maximally 0.9 to 1.1 times the thickness of the webs multiplied by the cosine of half the opening angle O divided by the sine of the whole opening angle O.

9 Claims, 6 Drawing Sheets

(52) U.S. Cl.
CPC ..... *B01F 2005/0638* (2013.01); *B01F 2005/0639* (2013.01); *B01F 2215/0049* (2013.01); *B01F 2215/0422* (2013.01); *B01F 2215/0427* (2013.01); *B01F 2215/0431* (2013.01)

(58) Field of Classification Search
USPC ..... 366/336–340
See application file for complete search history.

(56) References Cited

FOREIGN PATENT DOCUMENTS

| | | | | |
|---|---|---|---|---|
| DE | 19501241 | A1 | 8/1995 | |
| EP | 0526393 | A1 * | 2/1993 | ..... B01F 5/0618 |
| EP | 0526393 | A1 | 2/1993 | |

OTHER PUBLICATIONS

Machine translation for EP 0526393 A1 (Year: 1993).*
International Search Report for International Patent Application No. PCT/EP2017/075244, dated Jan. 18, 2018. English translation attached).
Written Opinion for International Patent Application No. PCT/EP2017/075244, dated Jan. 18, 2018.

* cited by examiner

MIXING ELEMENTS WITH A REDUCED STRUCTURAL DEPTH FOR STATIC MIXERS

CROSS REFERENCE TO RELATED APPLICATIONS

This application is a U.S. national stage application, filed under 35 U.S.C. § 371, of International Application No. PCT/EP2017/075244, which was filed on Oct. 4, 2017, and which claims priority to European Patent Application No. 16192324.8, which was filed on Oct. 5, 2016. The contents of each are incorporated by reference into this specification.

FIELD

The invention relates to mixing elements of reduced structural depth for static mixers, to static mixers comprising at least two mixing elements of reduced structural depth, and also to a method for mixing fluids by means of a mixing element of reduced structural depth or by means of a static mixer comprising at least two mixing elements of reduced structural depth.

BACKGROUND

In the course of production of polymers it is frequently necessary to mix high-viscosity fluids—polymer melts, for example—with one another. Thus, for example, it may be necessary to mix one polymer melt with another, additized polymer melt. For this purpose it has long been practice to use devices including those known as static mixers. These mixers are then, for example, into tubular housings in such a way that the polymer melts to be mixed are mixed as they flow through the static mixers in a main flow direction which corresponds to the longest axis of such a tube. The viscosities of high-viscosity fluids of this kind are customarily in the range from 0.1 to 10 000 Pas, measured using commercial viscometers known to the skilled person, such as capillary, plate/cone or plate/plate viscometers. If the viscosity of a fluid is independent of any shearing, it is referred to as a newtonian fluid. If the viscosity of a fluid is dependent on shearing, it is referred to as a non-newtonian fluid. If the viscosity of a fluid falls as shearing increases, it is referred to as a shear-thinning fluid. If the viscosity of a fluid rises as viscosity increases, it is referred to as a shear-thickening fluid. A brief overview of the rheological properties of polymer melts is found for example in "Kohlgrüber: Der gleichläufige Doppelschneckenextruder, Hanser-Verlag, 2007", chapter 3, pages 37 to 57.

These static mixers are constructed, for example, of a plurality of mixing elements. These mixing elements are usually formed as one piece and may have an outer sleeve in which one or more transverse struts are installed. The shape of these transverse struts is substantially that of an elongate body, as for example of an elongate cuboid, cylinder or body of triangular, ellipsoidal or other base area, which is installed by the long side, i.e., the transverse strut length, at right angles to the main flow direction, in the outer sleeve, and in which one of the two shorter sides, i.e., the transverse strut width, is both at right angles to the long side and at right angles to the main flow direction. Extending at right angles to the transverse strut width, but parallel to the main flow direction, is the transverse strut thickness, i.e., the thickness of the transverse strut. Where there is more than one transverse strut, these struts are arranged parallel to one another in two planes as viewed in the main flow direction. Departing from these one or more transverse struts, on each side of the respective transverse strut, to the inner face of the outer sleeve and/or to the nearest transverse strut, is at least one web, in such a way that the width of the openings which are made through the webs in the free cross section of the static mixer is equal to the width of the webs. The webs which extend from the same transverse strut in different directions enclose an angle of less than 180°, the opening angle O.

The shape of the webs as well is substantially that of an elongate body, as for example of an elongate cuboid, cylinder or body with triangular, ellipsoidal or other base area. The webs depart from the transverse strut substantially at right angles by their long side, i.e., the web length. The extent of the side of the webs that faces the flow of the fluid is the web width; the extent of the webs that is oriented at right angles both to the web length and to the web width is the web thickness.

A first purpose of the outer sleeve is to allow the mixing element to be installed into a tube, for example, without tipping, and a second purpose is to increase the mechanical strength of the mixing element. The sleeve, however, can also be omitted if transverse struts and webs withstand the anticipated mechanical loading and are suitably joined to one another or placed over one another in such a way that they do not slip. Conventional mixing elements of this kind are part of the disclosure content of Lars Frye "Charakterisierung von statischen Mischern für hochviskose einphasige Medien", Dissertation, University of Karlsruhe (TH), Institute of Mechanical Process Engineering and Mechanics, Division of Applied Mechanics, February 1999; see, in particular, pages 6 and 7 and FIGS. 2.7 and 2.8.

From the prior art it is also known that the webs of a first mixing element of two mixing elements of the same kind disposed one after another lie in each case flush one after another with the intermediate spaces of a second mixing element, with one of the two mixing elements being at 1800 to the other mixing element about its axis perpendicular to the main flow direction and lying parallel to the transverse struts, but that the two mixing elements one after another of the same kind have no contortion relative to one another, in the plane lying normal to the main flow direction, relative to the other mixing element. In that case a possible third mixing element directly following the second mixing element generally has the same orientation as the first mixing element, and a possible fourth mixing element directly following the third mixing element generally has the same orientation as the second mixing element. Other orientations of the mixing elements in a static mixer, however, are also possible.

The transverse strut sides of these mixing elements that face away from the webs of the respective mixing element lie directly on one another.

The mixing elements are typically installed in a 4+4 arrangement, i.e., two sets of four mixing elements arranged directly after one another are arranged as described above, with the second four mixing elements being directly adjacent to the first four mixing elements, but with the second four mixing elements being turned by 90° relative to the first four mixing elements in the plane lying normal to the main flow direction. Of course, 2+2, 2+3, 3+2, 3+3, 3+4, 4+3 or any other desired arrangements are also possible. Arrangements of at least two mixing elements arranged directly one after another are also called static mixers. In the case of the 3+3 arrangement of a static mixer, the number of mixing elements is preferably a multiple of 3. In the case of the 4+4 arrangement, the number of mixing elements is preferably a multiple of 4. In the case of the x+x arrangement, the number of mixing elements is preferably x. In the case of the x+y arrangement, x being different from y, the number of mixing elements is preferably a multiple of x+y, where x and y are each identical or different integers greater than or equal to 2.

Known from the prior art in accordance with DE 2943688 A1 is a static mixer which consists of a tubular housing and includes at least one mixing element arranged therein. The mixing element consists of intersecting webs which have an angle with respect to the tube axis. The webs of the mixing elements are arranged in at least two groups. The webs within each group have substantially parallel direction. The webs of one group intersect with the webs of the other group.

DE 4428813 A1 shows a static mixer which in contrast to DE 2943688 A1 has intersecting webs which overlap in the region of the intersects. The purpose of this local widening of the webs, which in DE 4428813 A1 take the form of sheet steel rods, is to strengthen and/or to form a positive connection of adjacent webs. Incised into the widening is a groove which accommodates an adjacent sheet steel rod.

EP 0856353 A1 shows a module which is part of a static mixer which is intended for a plastically fluid mix material for which the dwell time is critical. The installation encompasses a tubular housing in which webs are arranged. The webs are inclined against the longitudinal axis of the housing; they intersect one another substantially on a straight line perpendicular to the longitudinal axis. The module comprises a sleeve, which can be inserted into the housing. The inner wall of the static mixer, which guides the mix material, is formed by insides of the sleeve. The webs take the form of spikes, each with a vertex pointing against the direction of movement of the mix material, and a base attached to the inside of the sleeve. Each vertex forms an intermediate space with respect to the inner wall of the installation.

In the past, attempts have repeatedly been made to improve the mixing elements known from the prior art, in terms of improving the mixing outcome and of reducing the pressure loss during mixing, but without any resounding success.

One proposal for improving the mixing elements is disclosed in WO 2009000642 A1, for example. WO 2009000642 A1 discloses mixing elements in which there are at least in part spaces between adjacent webs. The aim of this is to improve the mixing outcome while at the same time reducing the pressure loss during mixing.

It has been found, however, that for numerous mixing requirements in the production of polymers, a further improvement is desirable in the mixing outcome in conjunction with reduction of the pressure loss during mixing.

The reduction in the pressure loss may advantageously be achieved by lowering the specific action of the mixing element or static mixer.

The specific action is a dimensionless characteristic for describing mixing elements and static mixers, and comprises, in the numerator, the pressure loss in the mixing element or static mixer and the residence time of the fluid in the mixing element or static mixer, and, in the denominator, the viscosity of the fluid. Comprehensive details of the specific action are found in Dolling, E.: "Zur Darstellung von Mischvorgängen in hochviskosen Flüssigkeiten", Dissertation RWTH Aachen, 1971.

The specific action is defined as $$W = \frac{\Delta p\ V}{\eta\ V} = \frac{\Delta p\ t_v}{\eta}$$

where W is the specific action, Δp the pressure loss, V the volume, η the dynamic viscosity, and $\dot{V}$ the volumetric throughput, and, respectively, $t_v$ the residence time.

Where the transiting exhibits newtonian behavior, pressure loss and residence time are in inverse proportion to one another; in other words, the product of the two variables is constant for one and the same mixer under otherwise identical conditions. The residence time in this context is the ratio of the free volume of the mixing element or static mixer to the volume flow through the mixer.

Depending on the technical task at hand, different variables may be of importance.

For example, for a given mixing task with a given product, there may be a certain available pressure loss which for technical reasons associated with the facility must not be exceeded. With this as a framework condition, it would be desirable to minimize the volume of the static mixer, and hence to minimize apparatus size (and therefore the costs of the static mixer) and the residence time, which at the high temperatures of the polymer processing leads typically to a deterioration in product properties.

A further technical function addressed may be that of accomplishing a given mixing task, with residence time and apparatus size that are mandated for reasons of quality and the facility, with as small a pressure loss as possible, so as to save on energy.

Moreover, a technical task may be that of lowering the temperature for the purpose of increasing the quality, with a required throughput, degree of mixing and allowable pressure loss. As the skilled person is aware, lowering the temperature in the context of polymer melts typically slows down harmful secondary reactions and so increases the product quality, though at the same time, when the temperature is lowered, the viscosity of polymer melts goes up, and so there may be a limitation in the pressure loss.

All of these tasks may be summarized as that of solving a given mixing task while minimizing the specific action.

Furthermore, for example, in an industrial production process such as the production of polymers, both the fluid and, with it, its viscosity, and also the volume flow are fixed, owing for example to the size of the facility and production requirements, and hence also in a pipe in which the mixing element and/or static mixer are located, the specific action can only be reduced by increasing the free volume of the mixer and/or static mixing element. This, however, would increase the residence time of the fluid in the mixer, which is undesirable, since in the case of the production of polymers, for example, a longer residence time commonly leads to a deterioration in the quality of the polymers. Moreover, a larger free volume of a mixing element or static mixer can frequently be achieved only through a larger diameter of the mixing element or static mixer, with otherwise the same geometry. This in turn has the disadvantages that the pipe in which the mixing element or static mixer is installed must be made larger and therefore more expensive, and that it becomes more difficult to switch from the production of one polymer to the production of another polymer.

SUMMARY

It is an object of the present invention, therefore, to provide a mixing element which for the same or better mixing outcome exhibits a lower pressure loss. This lower pressure loss is to be achieved without an increase in the residence time or in the diameter or the free volume of the mixing element or static mixer.

The mixing outcome may be evaluated, for example, via the measurement of a concentration distribution at the exit from the static mixers. Frequently for this purpose the concentration distribution is collated into an integral degree of mixing. An overview of this is given by "Kohlgrüber: Der gleichläufige Doppelschneckenextruder, Hanser-Verlag, 2007" in chapter 9 on pages 184 to 188.

The object is achieved by a mixing element which has at least one transverse strut from which there originate, at right angles to the longest extent of the transverse strut, at least three webs, at least one web of these at least three webs lying in alternation relative to at least two webs with respect to the longest extent of the transverse strut, and the webs lying on opposite sides of the transverse strut enclosing an angle (opening angle O) of 60° to 1200, preferably of 75° to 1050, more preferably of 85° to 950, more particularly of 90°, characterized in that the thickness of the transverse strut (dQ) at its thickest point is 0.9 to 1.1 times the thickness of the webs (dS) multiplied by the cosine of half the opening angle O divided by the sine of the full opening angle O, i.e., dQ=dS*cos (0.5*O)/sin O+/−0.1*dS*cos (0.5*O)/sin O=(1+/−0.1)*dS*cos (0.5*O)/sin O.

BRIEF DESCRIPTION OF THE DRAWINGS

The invention is elucidated below by drawings, without being thereby limited to the embodiments shown in the drawings.

DETAILED DESCRIPTION

Figure 1:
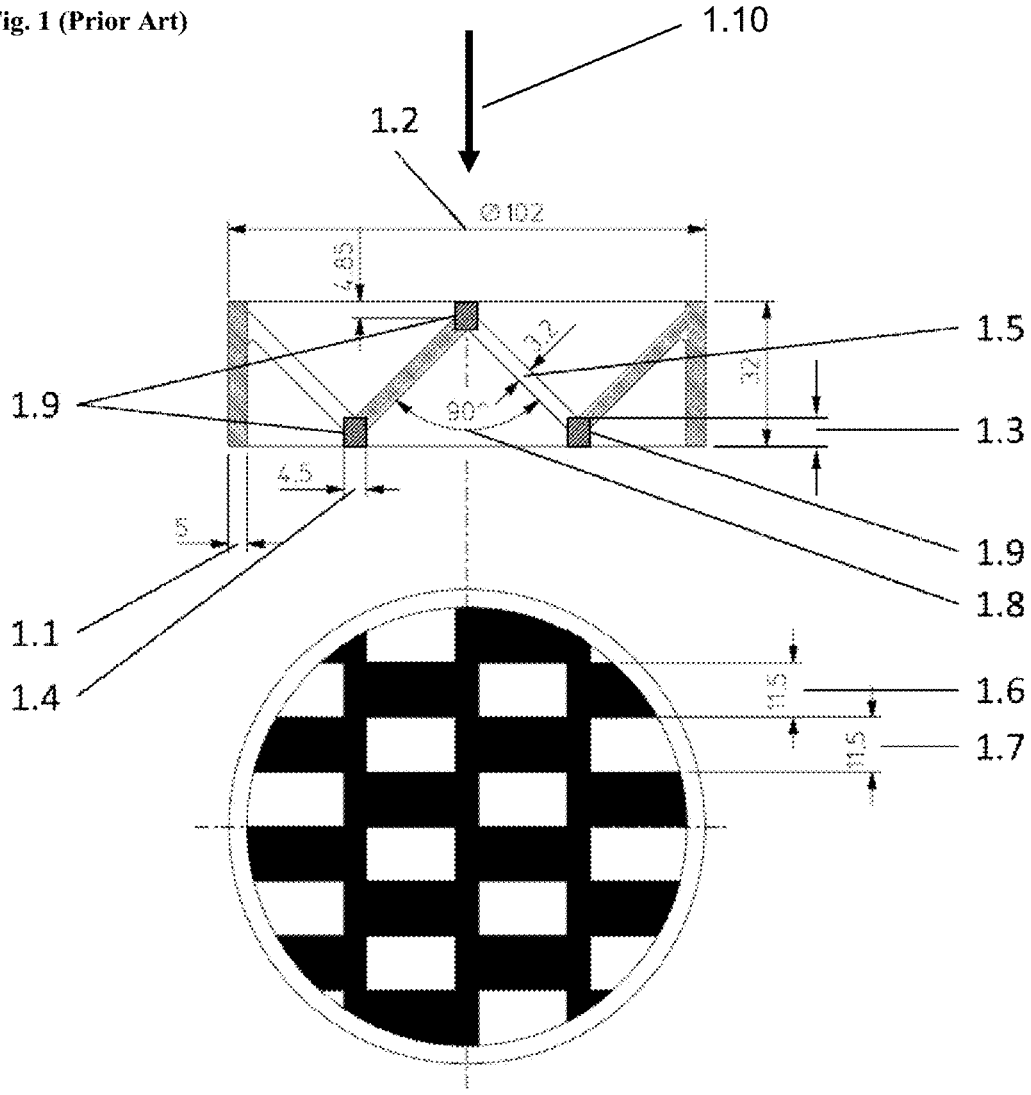
Fig. 1 (Prior Art)
FIG. 1 shows a prior-art mixing element with sleeve in cross section and in plan view. The dimensioning of distances is in millimeters; the dimensioning of the angle is in degrees.

Preferably the thickness of the transverse strut (dQ) at its thickest point is 0.95 to 1.05 times the thickness of the webs (dS) multiplied by the cosine of half the opening angle O divided by the sine of the full opening angle O, i.e. dQ=(1+/−0.05)*dS*cos (0.5*O)/sin O, very preferably 0.98 to 1.02 times the thickness of the webs (dS) multiplied by the cosine of half the opening angle O divided by the sine of the full opening angle O, i.e. dQ=(1+/−0.02)*dS*cos (0.5*O)/sin O, and in particular the thickness of the transverse strut dQ=dS*cos (0.5*O)/sin O.

With further preference the thickness dQ of the transverse strut is the same over a continuous distance, including the middle of the transverse strut length, of 90%, preferably more than 95%, more preferably more than 98%, very preferably more than 99% of the transverse strut length, with a deviation of not more than 5%, preferably not more than 2%, more preferably not more than 1%.

With further preference at least the side of a transverse strut (transverse strut side) facing the webs has the form of a rectangle, this rectangle lying at right angles to the main flow direction of the fluids.

With further preference the thickness of the webs (dS) is 0.01 to 0.07, preferably 0.015 to 0.06, and very preferably 0.02 to 0.05 times the diameter of the mixing element at right angles to the main flow direction.

The mixing element of the invention may have a sleeve. Where the mixing element of the invention has a sleeve, the outer faces of the transverse struts and the end faces of the sleeve lie in one plane.

Surprisingly it has been found that not only does such a mixing element bring about a better mixing outcome than mixing elements from the prior art, but also that the pressure loss during mixing is lower, without the residence time being increased or the diameter or the free volume of the mixing element or static mixer being increased. It is therefore possible to operate with a reduced entry pressure upstream of the mixing element.

By means of the reduced pressure loss, firstly, there is a saving on the energy needed to generate the pressure, and secondly the reduced pressure loss leads to a lower temperature increase during the mixing process. This in turn reduces temperature-related damage affecting the fluid to be mixed or fluids to be mixed with one another. With a higher pressure loss, moreover, greater expenditure on apparatus is required, in the form, for example, of more powerful pumps and thicker walls.

It has surprisingly been found as well, moreover, that for the same or better mixing outcome, the pressure loss through the mixing element of the invention can be diminished additionally if in the main flow direction, the width of the opening between two adjacent webs which lie on the same side of the transverse strut from which they depart is greater than the width of a web. This web width of these two webs in this case is substantially the same.

An additional advantage of the mixing element of the invention is that it has a lower structural depth than a comparable mixing element from the prior art. A mixing element of the invention, accordingly, has a structural depth reduced by twice the thickness of the transverse strut. For an opening angle O of 90° and a customary ratio of static mixer diameter to web thickness of 20:1, this may easily achieve a structural depth which is approximately 20% lower. The space saving resulting from this is desirable technically, particularly since in general there is not only one mixing element of the invention but rather numerous mixing elements of the invention installed in a pipe through which the fluids for mixing are flowing. In analogy to the prior-art static mixers already described earlier on above, these mixing elements then form a static mixer of the invention.

This achieves the additional object of providing a mixing element which, for the same or better mixing outcome and simultaneous reduction in pressure loss, has a lower structural depth than comparable mixing elements from the prior art.

An effect of the lower structural depth on the part of the mixing element of the invention is a lower residence time of the fluid to be mixed or fluids to be mixed with one another in the mixing element. This in turn reduces the thermal loads and consequently temperature-related damage affecting the fluid to be mixed or fluids to be mixed with one another.

Additionally it has surprisingly been found that if at least two of the mixing elements of the invention are arranged bordering on the one another directly so that their transverse strut sides facing one another lie flush one after another and are in contact over their full area, with one of the two mixing elements being rotated by 180° relative to the other mixing element about its axis perpendicular to the main flow direction and lying parallel to the transverse struts, but the two mixing elements lying one after another and of the same kind have no rotation relative to one another in the plane lying normal to the main flow direction, relative to the other mixing element, the mechanical strength of the static mixer of the invention constructed from the at least two mixing elements of the invention, by comparison with a static mixer constructed from the same number of conventional mixing elements in the same arrangement as the mixing elements of the invention, is not lowered but is in fact increased in the flow direction, while in the other directions it remains at least the same.

With an arrangement in accordance with the invention of this kind, the interfaces of the imaginary prolongations of the outer contours of the webs in the region of the cross section of a transverse strut, the section being taken at right angles to the transverse strut length and at right angles to the transverse strut width, in other words parallel to the transverse strut thickness (dQ), form a rhombus. For an opening angle O of 90°, this rhombus is a square.

The effect of this arrangement in accordance with the invention is that flows of force are uniform. In particular, the flows of force through the webs without deflection are transmitted directly from one mixing element of the invention to the subsequent mixing element of the invention, thus preventing torques at the transition between web and transverse strut, and also preventing the associated additional shearing stresses. Consequently, as already maintained earlier on above, the strength is increased. Other advantages of the mixing element of the invention and of the static mixer of the invention are the saving on material for production of the mixer, and the fact that increased throughput can be tolerated.

When using the mixing elements of the invention, therefore, there is no risk of a mixing element of the invention or of a static mixer constructed from at least two mixing elements of the invention becoming compressed under the load of the fluid in motion. On the contrary: the mixing element of the invention is suitable for greater loading than a corresponding prior-art mixing element, and a static mixer composed of at least two mixing elements of the invention is suitable for greater loading than a corresponding prior-art static mixer.

The advantages of the mixing element of the invention—viz. the improved mixing outcome, the lower pressure loss, and the greater mechanical strength—are manifested particularly if at least two of the mixing elements of the invention are present in a static mixer. In particular, the advantages of the mixing element of the invention are manifested if the at least two mixing elements of the invention are directly adjacent and if one mixing element of the invention is rotated by 180° to the respectively adjacent mixing element about its axis perpendicular to the main flow direction and lying parallel to the transverse struts, so that the transverse strut sides of the mixing elements that face away from the webs of the respective mixing element lie directly on one another and contact one another over their full area. The advantages of the mixing element of the invention are manifested very particularly if at least two of the mixing elements of the invention form a static mixer, in other words if the static mixer is constructed exclusively of the mixing elements of the invention.

Another subject of the present invention, therefore, is a static mixer comprising at least two mixing elements of the invention. A subject of the present invention more particularly is also a static mixer constructed exclusively of the mixing elements of the invention.

Here, one or more, or all, of the mixing elements of the invention may or may not have a sleeve. The static mixer of the invention as well may or may not have a sleeve.

A sleeve of this kind may on the outside have marking grooves or marking pins which hinder or prevent incorrect installation or assembly of the mixing element or static mixer into a tube through which there flow the fluids to be mixed.

A further subject of the present invention is also a method for mixing fluids using a mixing element of the invention. A further subject of the present invention more particularly is also a method for mixing using a static mixer of the invention.

Fluids which can be mixed advantageously using a mixing element of the invention or a static mixer of the invention are the aforesaid polymer melts or other fluids having a viscosity of 0.1 to 10 000 Pas. Hence a mixing element of the invention or a static mixer of the invention may also be used, for example, to mix one polymer melt with another, additized polymer melt, or to mix a polymer melt with a solvent. This operation takes place, for example, during the production of polymers or mixtures of polymers. Accordingly, the mixing element of the invention and the static mixer of the invention also serve for the production of polymers and mixtures of polymers and polymer solutions. The components to be mixed may form a homogeneous mixture (no phase boundary observable between the components) or a disperse mixture (phase boundary observable between the components). If a component is dispersed, this disperse phase may be solid, liquid or gaseous. The components to be mixed may have the same viscosity or a viscosity different from one to another. The viscosity ratios may be up to 1:10 000. The proportions—in weight fractions for solids and liquids and in volume fractions for gases—are from 0.1:99.9% to 50:50%, preferably 3:97% to 15:85%. The polymer melt or polymer melts preferably comprise a melt of a thermoplastic polymer or melts of two or more thermoplastic polymers. A thermoplastic polymer is also referred to for short below as "thermoplastic".

Processed with particular preference using a mixing element of the invention or using a static mixer of the invention are thermoplastic polymers from the series encompassing polycarbonate, polyamide, polyesters, especially polybutylene terephthalate or polyethylene terephthalate, polyethers, thermoplastic polyurethane, polyacetal, fluoropolymer, especially polyvinylidene fluoride, polyethersulfones, polyolefin, especially polyethylene or polypropylene, polyimide, polyacrylate, especially poly(methyl) methacrylate, polyphenylene oxide, polyphenylene sulfide, polyetherketone, polyaryletherketone, styrene polymers, especially polystyrene, styrene copolymers, especially styrene-acrylonitrile copolymer, acrylonitrile-butadiene-styrene block copolymer or polyvinyl chloride. Likewise processed preferably with a mixing element of the invention or with a static mixer of the invention are blends, so called, of the polymers listed, as understood by the skilled person to refer to a combination of two or more polymers. Particularly preferred are polycarbonate and blends containing polycarbonate, the polycarbonate having been obtained very preferably by the interfacial process or by the melt transesterification process.

It is known, further, that with a mixing element of the invention or with a static mixer of the invention it is possible to process further fluids such as, for example, oils, epoxy resins, polyurethanes, foodstuffs, paints and varnishes, creams, pastes, metal melts, salt melts or glass melts.

Polymer solutions which as products can be processed with a mixing element of the invention or with a static mixer of the invention are, for example, rubbers or thermoplastics with their monomers and/or solvents. Processed preferably with a mixing element of the invention or with a static mixer of the invention are solutions of polymers selected from the series encompassing styrene-acrylonitrile copolymer with styrene, acrylonitrile and/or ethylbenzene, acrylonitrile-butadiene-styrene block copolymers with styrene, acrylonitrile, butadiene and/or ethylbenzene, polycarbonate with chlorobenzene and/or methylene chloride, polyamide with caprolactam or water, polyoxymethylene with formaldehyde, poly(methyl) methacrylate with methyl methacrylate, and polyethylene with hexane or cyclohexane. A mixing element of the invention or a static mixer of the invention is used with particular preference for processing polymer solutions comprising polycarbonate in chlorobenzene and/or methylene chloride.

Polycarbonates for the purposes of the present invention are not only homopolycarbonates but also copolycarbonates and/or polyester carbonates; the polycarbonates, in a known way, may be linear or branched. Also referred to in accordance with the invention are mixtures of polycarbonates.

The polycarbonates can be produced in a known way from diphenols, carbonic acid derivatives, optionally chain terminators, and branching agents. Details of the production of polycarbonates have been well-known to the skilled person for at least about 40 years. Reference may be made here, by way of example, to Schnell, Chemistry and Physics of Polycarbonates, Polymer Reviews, Volume 9, Interscience Publishers, New York, London, Sydney 1964, to D. Freitag, U. Grigo, P. R. Müller, H. Nouvertné, BAYER AG, Polycarbonates in Encyclopedia of Polymer Science and Engineering, Volume 11, Second Edition, 1988, pages 648-718, and finally, to U. Grigo, K. Kirchner, and P. R. Müller, Polycarbonate in Becker/Braun, Kunststoff-Handbuch, Volume 31, Polycarbonates, Polyacetals, Polyesters, Cellulose esters, Carl Hanser Verlag Munich, Vienna 1992, pages 117-299.

Aromatic polycarbonates are produced, for example, by reaction of diphenols with carbonic halides, preferably phosgene, and/or with aromatic dicarboxylic dihalides, preferably benzene dicarboxylic dihalides, by the interfacial process, optionally with use of chain terminators and optionally with use of branching agents having a functionality of three or more than three. Also possible is production via a melt polymerization process, by reaction of diphenols with, for example, diphenyl carbonate. Examples of diphenols suitable for production of the polycarbonates are hydroquinone, resorcinol, dihydroxybiphenyls, bis(hydroxyphenyl)alkanes, bis(hydroxyphenyl)cycloalkanes, bis(hydroxyphenyl) sulfides, bis(hydroxyphenyl) ethers, bis(hydroxyphenyl) ketones, bis(hydroxyphenyl) sulfones, bis (hydroxyphenyl) sulfoxides, α-α'-bis(hydroxyphenyl) diisopropylbenzenes, phthalimidines derived from isatin or phenolphthalein derivatives, and also to the related ring-alkylated, ring-arylated, and ring-halogenated compounds.

Preferred diphenols are 4,4'-dihydroxybiphenyl, 2,2-bis (4-hydroxyphenyl)propane (bisphenol A), 2,4-bis(4-hydroxyphenyl)-2-methylbutane, 1,1-bis(4-hydroxyphenyl)-p-diisopropylbenzene, 2,2-bis(3-methyl-4-hydroxyphenyl) propane, dimethyl bisphenol A, bis(3,5-dimethyl-4-hydroxyphenyl)methane, 2,2-bis(3,5-dimethyl-4-hydroxyphenyl)propane, bis(3,5-dimethyl-4-hydroxyphenyl) sulfone, 2,4-bis(3,5-dimethyl-4-hydroxyphenyl)-2-methylbutane, 1,1-bis(3,5-dimethyl-4-hydroxyphenyl)-p-diisopropylbenzene, and 1,1-bis(4-hydroxyphenyl)-3,3,5-trimethylcyclohexane.

Particularly preferred diphenols are 2,2-bis(4-hydroxyphenyl)propane (bisphenol A), 2,2-bis(3,5-dimethyl-4-hydroxyphenyl)propane, 1,1-bis(4-hydroxyphenyl)cyclohexane, 1,1-bis(4-hydroxyphenyl)-3,3,5-trimethylcyclohexane, and dimethyl bisphenol A.

These and other suitable diphenols are described for example in U.S. Pat. Nos. 3,028,635, 2,999,825, 3,148,172, 2,991,273, 3,271,367, 4,982,014, and 2,999,846, in DE-A 1 570 703, DE-A 2 063 050, DE-A 2 036 052, DE-A 2 211 956, and DE-A 3 832 396, in FR-A 1 561 518, in the monograph by H. Schnell in Chemistry and Physics of Polycarbonates, Interscience Publishers, New York 1964 and also in JP-A 62039/1986, JP-A 62040/1986, and JP-A 105550/1986.

In the case of the homopolycarbonates, only one diphenol is used; in the case of the copolycarbonates, two or more diphenols are used.

Suitable carbonic acid derivatives are, for example, phosgene or diphenyl carbonate.

Suitable chain terminators which can be used in producing the polycarbonates are monophenols. Examples of suitable monophenols are phenol itself, alkylphenols such cresols, p-tert-butylphenol, cumylphenol, and mixtures thereof.

Preferred chain terminators are the phenols which are singly or multiply substituted by $C_1$ to $C_{30}$ alkyl radicals, linear or branched, preferably unsubstituted, or substituted by tert-butyl. Particularly preferred chain terminators are phenol, cumylphenol and/or p-tert-butylphenol. The amount of chain terminator to be used is preferably 0.1 to 5 mol %, based on moles of diphenols employed in each case. The chain terminators may be added before, during or after the reaction with a carbonic acid derivative.

Suitable branching agents are the compounds with a functionality of three or more than three that are known in polycarbonate chemistry, especially those having three or more than three phenolic OH groups.

Examples of suitable branching agents are 1,3,5-tri(4-hydroxyphenyl)benzene, 1,1,1-tri(4-hydroxyphenyl)ethane, tri(4-hydroxyphenyl)phenylmethane, 2,4-bis(4-hydroxyphenylisopropyl)-phenol, 2,6-bis(2-hydroxy-5'-methyl-benzyl)-4-methylphenol, 2-(4-hydroxyphenyl)-2-(2,4-dihydroxyphenyl)propane, tetra(4-hydroxyphenyl)methane, tetra(4-(4-hydroxyphenylisopropyl)-phenoxy)methane, and 1,4-bis((4',4-dihydroxytriphenyl)methyl)benzene and 3,3-bis(3-methyl-4-hydroxyphenyl)-2-oxo-2,3-dihydroindole.

The amount of any branching agents to be used is preferably 0.05 mol % to 3 mol %, based on moles of diphenols used in each case. The branching agents may either be included in the initial charge with the diphenols and the chain terminators in the aqueous-alkaline phase, or added in solution in an organic solvent before the phosgenation. In the case of the transesterification process, the branching agents are used together with the diphenols.

Particularly preferred polycarbonates are the homopolycarbonate based on bisphenol A, the homopolycarbonate based on 1,3-bis(4-hydroxyphenyl)-3,3,5-trimethylcyclohexane, and the copolycarbonates based on the two monomers bisphenol A and 1,1-bis(4-hydroxyphenyl)-3,3,5-trimethylcyclohexane.

Additionally it is possible optionally, based on the weight of the thermoplastic, for there to be up to 50.0 wt %, preferably 0.2 to 40 wt %, more preferably 0.10 to 30.0 wt %, of other customary additives present.

This group encompasses flame retardants, antidrip agents, heat stabilizers, mold release agents, antioxidants, UV absorbers, IR absorbers, antistats, optical brighteners, light-scattering agents, colorants such as pigments, including inorganic pigments, carbon black and/or dyes, and inorganic fillers in amounts customary for polycarbonate. These additives may be added individually or else in a mixture.

Such additives as are customarily added in the case of polycarbonates are described for example in EP-A 0 839 623, WO-A 96/15102, EP-A 0 500 496 or "Plastics Additives Handbook", Hans Zweifel, 5th Edition 2000, Hanser Verlag, Munich.

In the production of a polycarbonate, the mixing elements or static mixers of the invention are used preferably after the last devolatilization stage of the polycarbonate. In the case of production of polycarbonate by the interfacial process, this stage is generally after a tube or strand devolatilizer, and in the case of production of polycarbonate by the melt polymerization process, after a high-viscosity reactor. Upstream in flow direction of a mixing element or static mixer of the invention, a main flow of unadditized polycarbonate is fed with a secondary flow of additized polycarbonate. The mixing ratio here is in a range from 99:1 to 80:20, preferably 98:2 to 85:15, more preferably from 95:5 to 90:10, in each case by weight fraction.

If a mixing element of the invention or a static mixer of the invention is used in the production of polycarbonate, it has the effect—through the lower temperature increase caused by the lower pressure loss, and by the lower residence time caused by the lower structural depth—of reducing temperature damage to the polycarbonate. This in turn yields a polycarbonate whose yellowing is lower and transparency higher than that of a polycarbonate produced under otherwise identical conditions but without the use of a mixing element of the invention or a static mixer of the invention.

Another subject of the present invention, therefore, is a method for producing polycarbonate using a mixing element of the invention. Also a subject of the present invention, therefore, is a method for producing polycarbonate using a static mixer of the invention.

The invention is elucidated below by drawings, without being thereby limited to the embodiments shown in the drawings.

Figure 2:
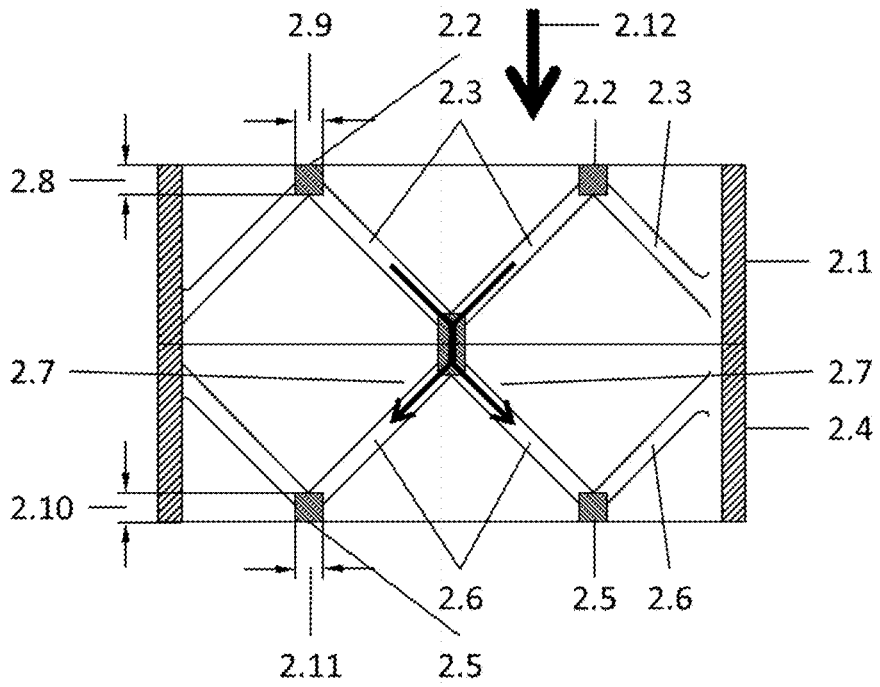
Fig. 2 (Prior Art)
FIG. 2 shows a cross section of a static mixer consisting of two prior-art mixing elements with drawn-in arrows indicating the force flows through the webs and the transverse strut when the force acts perpendicularly from above on the mixing element.
Figure 3:
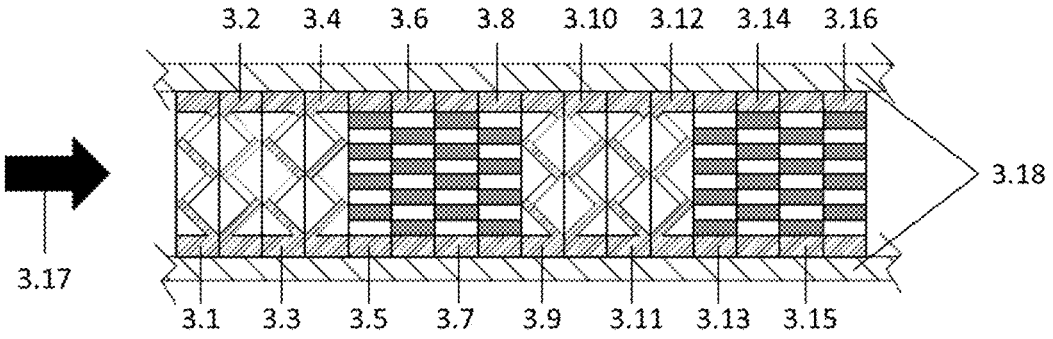
Fig. 3 (Prior Art)
FIG. 3 shows a longitudinal section through a tube with a static mixer formed of a dual 4+4 arrangement of prior-art mixing elements.

FIG. 1 shows a prior-art mixing element with sleeve in cross section and in plan view. The dimensioning of distances is in millimeters; the dimensioning of the angle is in degrees; the key is as follows:

1.1 thickness of the sleeve
1.2 diameter of the mixing element including sleeve
1.3 thickness dQ of the transverse strut
1.4 width of the transverse strut
1.5 thickness dS of the web
1.6 width of the web
1.7 width of the opening between two webs
1.8 opening angle O
1.9 transverse struts
1.10 main flow direction FIG. 2 shows a cross section of a static mixer consisting of two prior-art mixing elements with drawn-in arrows indicating the force flows through the webs and the transverse strut when the force acts perpendicularly from above on the mixing element; the key is as follows:

2.1 sleeve of the upper mixing element
2.2 transverse struts of the upper mixing element
2.3 webs of the upper mixing element
2.4 sleeve of the lower mixing element
2.5 transverse struts of the lower mixing element
2.6 webs of the lower mixing element
2.7 force flows (indicated by arrows)
2.8 thickness dQ of the transverse strut of the upper mixing element
2.9 width of the transverse strut of the upper mixing element
2.10 thickness dQ of the transverse strut of the lower mixing element
2.11 width of the transverse strut of the lower mixing element
2.12 main flow direction FIG. 3 shows a longitudinal section through a tube with a static mixer formed of a dual 4+4 arrangement of prior-art mixing elements; the key is as follows:

3.1 first mixing element
3.2 second mixing element, rotated by 180° relative to the first mixing element about its axis perpendicular to the main flow direction and lying parallel to the transverse struts
3.3 third mixing element, oriented like first mixing element
3.4 fourth mixing element, oriented like second mixing element
3.5 fifth mixing element, oriented like first mixing element 3.1, but rotated, viewed in flow direction, by 90° in circumferential direction counterclockwise
3.6 sixth mixing element, rotated by 180° relative to the fifth mixing element about its axis perpendicular to the main flow direction and lying parallel to the transverse struts
3.7 seventh mixing element, oriented like fifth mixing element
3.8 eighth mixing element, oriented like sixth mixing element
3.9 ninth mixing element, oriented like first mixing element
3.10 tenth mixing element, oriented like second mixing element
3.11 eleventh mixing element, oriented like first mixing element

3.12 twelfth mixing element, oriented like second mixing element

3.13 thirteenth mixing element, oriented like fifth mixing element

3.14 fourteenth mixing element, oriented like sixth mixing element

3.15 fifteenth mixing element, oriented like seventh mixing element

3.16 sixteenth mixing element, oriented like eighth mixing element

3.17 main flow direction

3.18 tube in which the mixing elements are installed

Figure 4:
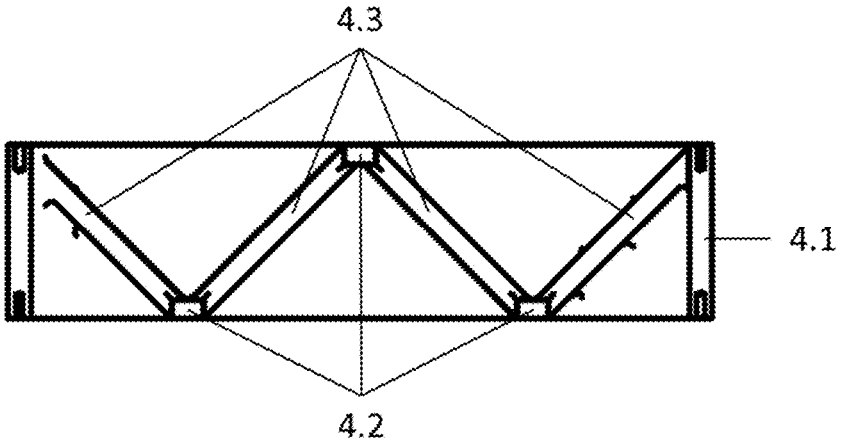
FIG. 4 shows a cross section of a mixing element of the invention along the section A-A from FIG. 5.

FIG. 4 shows a cross section of a mixing element of the invention along the section A-A from FIG. 5; the key is as follows:

4.1 sleeve

4.2 transverse struts

4.3 webs

Figure 5:
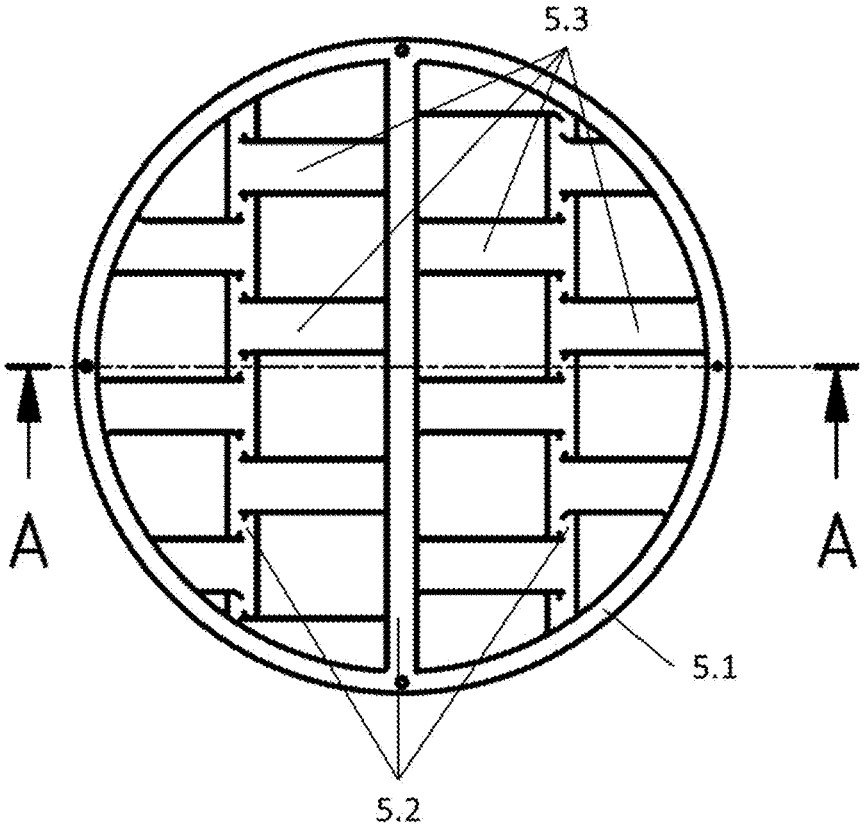
FIG. 5 shows the plan view of a mixing element of the invention.

FIG. 5 shows the plan view of a mixing element of the invention; the key is as follows:

5.1 sleeve

5.2 transverse struts

5.3 webs

Figure 6:
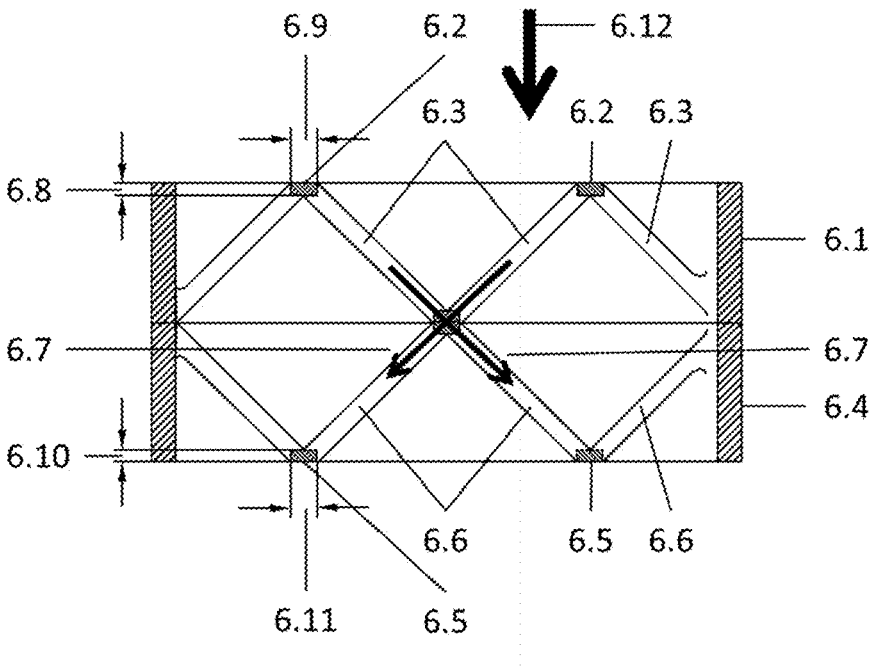
FIG. 6 shows a cross section of a static mixer of the invention consisting of two mixing elements of the invention with drawn-in arrows indicating the force flows through the webs and the transverse strut when the force acts perpendicularly from above on the mixing element.

FIG. 6 shows a cross section of a static mixer of the invention consisting of two mixing elements of the invention with drawn-in arrows indicating the force flows through the webs and the transverse strut when the force acts perpendicularly from above on the mixing element; the key is as follows:

6.1 sleeve of the upper mixing element

6.2 transverse struts of the upper mixing element

6.3 webs of the upper mixing element

6.4 sleeve of the lower mixing element

6.5 transverse struts of the lower mixing element

6.6 webs of the lower mixing element

6.7 force flows (indicated by arrows)

6.8 thickness dQ of the transverse strut of the upper mixing element

6.9 width of the transverse strut of the upper mixing element

6.10 thickness dQ of the transverse strut of the lower mixing element

6.11 width of the transverse strut of the lower mixing element

6.12 main flow direction

Figure 7:
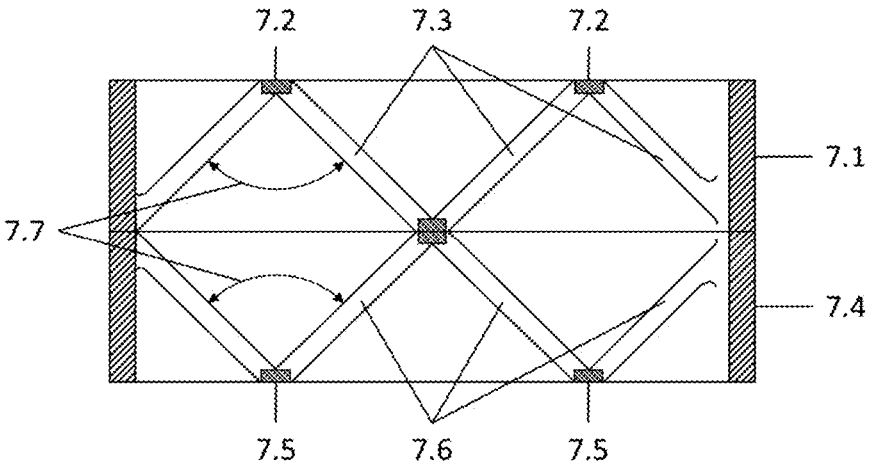
FIG. 7 shows a cross section of a static mixer consisting of two static mixing elements of the invention, with an opening angle O of approximately 90°.

FIG. 7 shows a cross section of a static mixer consisting of two static mixing elements of the invention, with an opening angle O of approximately 90°; the key is as follows:

7.1 sleeve of the upper mixing element

7.2 transverse struts of the upper mixing element

7.3 webs of the upper mixing element

7.4 sleeve of the lower mixing element

7.5 transverse struts of the lower mixing element

7.6 webs of the lower mixing element

7.7 opening angle O

Figure 8:
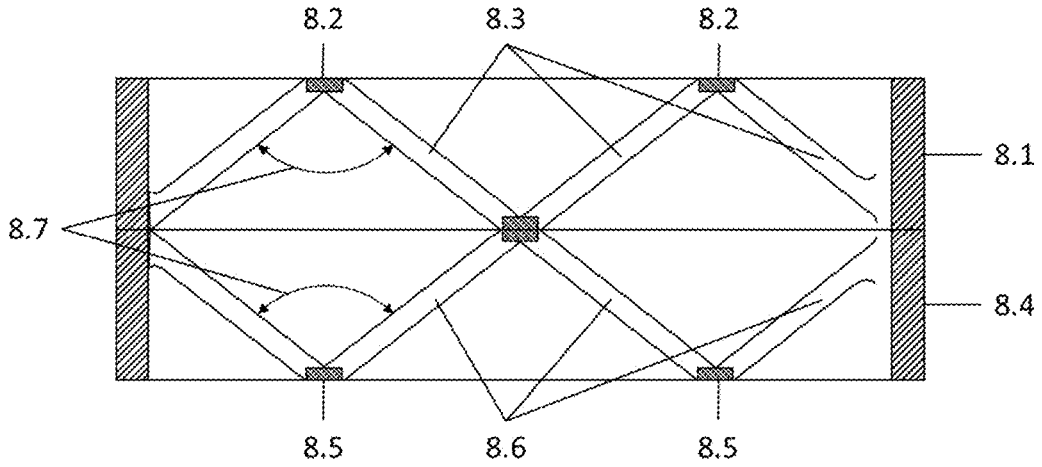
FIG. 8 shows a cross section of a static mixer consisting of two static mixing elements of the invention, with an opening angle O of greater than 90°.

FIG. 8 shows a cross section of a static mixer consisting of two static mixing elements of the invention, with an opening angle O of greater than 90°; the key is as follows:

8.1 sleeve of the upper mixing element

8.2 transverse struts of the upper mixing element

8.3 webs of the upper mixing element

8.4 sleeve of the lower mixing element

8.5 transverse struts of the lower mixing element

8.6 webs of the lower mixing element

8.7 opening angle O

Figure 9:
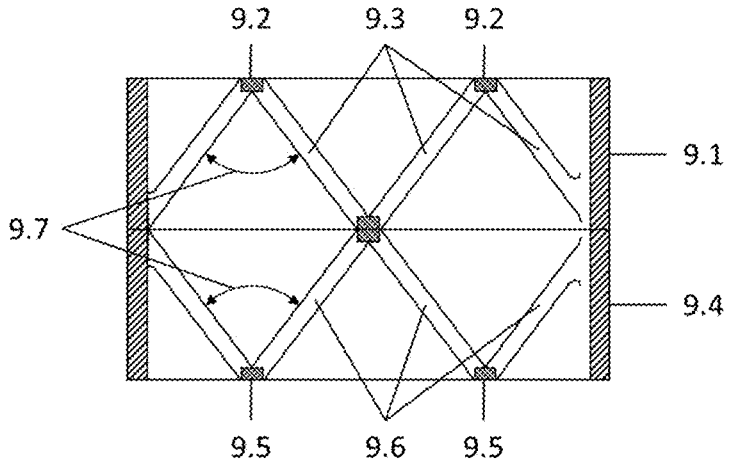
FIG. 9 shows a cross section of a static mixer consisting of two static mixing elements of the invention, with an opening angle O of less than 90°.

FIG. 9 shows a cross section of a static mixer consisting of two static mixing elements of the invention, with an opening angle O of less than 90°; the key is as follows:

9.1 sleeve of the upper mixing element

9.2 transverse struts of the upper mixing element

9.3 webs of the upper mixing element

9.4 sleeve of the lower mixing element

9.5 transverse struts of the lower mixing element

9.6 webs of the lower mixing element

9.7 opening angle O

Figure 10:
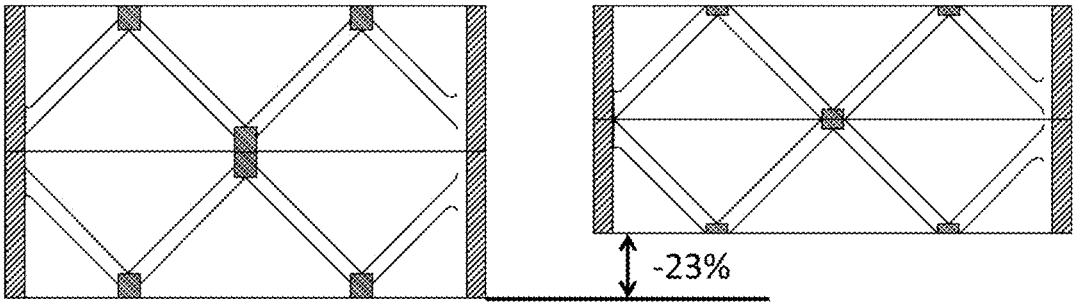
FIG. 10 shows on the left a longitudinal section through a conventional static mixer and on the right a longitudinal section through a static mixture of the invention with reduced structural height. The approximately 23% reduced structural height of the static mixer of the invention relative to the structural height of the prior-art static mixer is readily apparent. Also readily apparent is the fact that one of the two mixing elements is rotated by 180° relative to the other mixing element about its axis perpendicular to the main flow direction and lying parallel to the transverse struts, so that the transverse strut sides of these mixing elements that face away from the webs of the respective mixing element lie directly on one another and contact one another over the full area.

FIG. 10 shows on the left a longitudinal section through a conventional static mixer and on the right a longitudinal section through a static mixture of the invention with reduced structural height. The approximately 23% reduced structural height of the static mixer of the invention relative to the structural height of the prior-art static mixer is readily apparent. Also readily apparent is the fact that one of the two mixing elements is rotated by 180° relative to the other mixing element about its axis perpendicular to the main flow direction and lying parallel to the transverse struts, so that the transverse strut sides of these mixing elements that face away from the webs of the respective mixing element lie directly on one another and contact one another over the full area.

Figure 11:
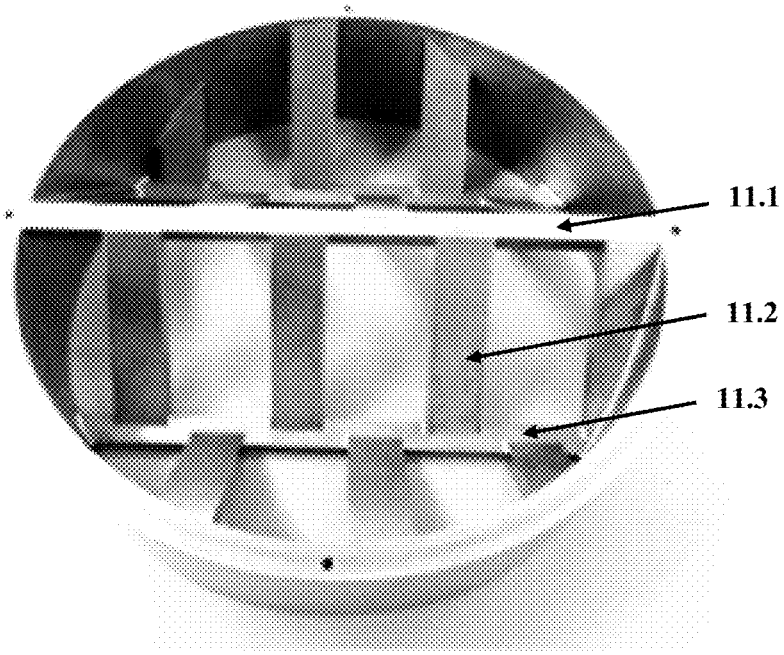
FIG. 11 shows a complete view of a static mixer of the invention where 11.1 is the upper transverse strut, 11.2 is the web, and 11.3 is the lower transverse strut.

FIG. 11 shows a complete view of a static mixer of the invention.

What is claimed is:

1. A mixing element which has at least one transverse strut from which there originate, at right angles to the longest extent of the transverse strut, at least three webs, at least one web of these at least three webs lying in alternation with at least two webs of the at least three webs with respect to the longest extent of the transverse strut, and the webs lying on opposite sides of the transverse strut enclosing an opening angle O of 60° to 120°, wherein the thickness of the transverse strut (dQ) at its thickest point is not more than 0.9 to 1.1 times the thickness of the webs (dS) multiplied by the cosine of half the opening angle O divided by the sine of the full opening angle O.

2. The mixing element as claimed in claim 1, wherein the webs lying on opposite sides of the transverse strut enclose an opening angle O of 75° to 105°.

3. The mixing element as claimed in claim 1 wherein the thickness of the transverse strut (dQ) at its thickest point is 0.95 to 1.05 times the thickness of the webs (dS) multiplied by the cosine of half the opening angle O divided by the sine of the full opening angle O.

4. The mixing element as claimed in claim 1, wherein the width of the opening between two adjacent webs which lie on the same side of the transverse strut from which they depart is greater, in the main flow direction, than the width of a web.

5. The mixing element as claimed in claim 1, wherein the mixing element comprises a sleeve.

6. The mixing element as claimed in claim 1, wherein the webs lying on opposite sides of the transverse strut enclose an opening angle O of 85° to 95°.

7. The mixing element as claimed in claim 1, wherein the webs lying on opposite sides of the transverse strut enclose an opening angle O of 90°.

8. The mixing element as claimed in claim 1, wherein the thickness of the transverse strut (dQ) at its thickest point is 0.98 to 1.02 times the thickness of the webs (dS) multiplied by the cosine of half the opening angle O divided by the sine of the full opening angle O.

9. The mixing element as claimed in claim 1, wherein the thickness of the transverse strut (dQ) at its thickest point is equal to the thickness of the webs (dS) multiplied by the cosine of half the opening angle O divided by the sine of the full opening angle O.

* * * * *